US006074270A

United States Patent [19]

Wilcox et al.

[11] Patent Number: 6,074,270

[45] Date of Patent: Jun. 13, 2000

[54] SUPPORT SYSTEM AND FLEXIBLE INTEGUMENT FOR DOLLS

[75] Inventors: Reed N. Wilcox, Littleton; Richard L. George, Englewood; W. Kenn Thiess, Aurora; Lane Anderson, Englewood, all of Colo.

[73] Assignee: The Lifelike Company, Englewood, Colo.

[21] Appl. No.: 09/134,781

[22] Filed: Aug. 14, 1998

Related U.S. Application Data

[60] Provisional application No. 60/055,703, Aug. 14, 1997.

[51] Int. Cl.[7] ..... A63H 3/02; A63H 3/04

[52] U.S. Cl. ..... 446/370; 446/383

[58] Field of Search ..... 446/370, 371, 446/373, 374, 375, 383

[56] References Cited

U.S. PATENT DOCUMENTS

| | | | |
|---|---|---|---|
| 1,601,447 | 9/1926 | Huck | 446/375 |
| 2,017,023 | 10/1935 | Rendle | 446/375 |
| 2,109,422 | 2/1938 | Haughton | 446/374 |
| 2,129,421 | 9/1938 | Hales | 446/375 |
| 2,285,472 | 6/1942 | Tenenbaum | 446/375 |
| 3,357,076 | 12/1967 | Greenwald et al. . | |
| 3,445,917 | 5/1969 | Adler . | |
| 4,123,872 | 11/1978 | Silva | 446/374 |
| 4,954,118 | 9/1990 | Refabert . | |
| 5,017,173 | 5/1991 | Shapero et al. | 446/370 X |
| 5,478,514 | 12/1995 | Hamilton . | |
| 5,620,352 | 4/1997 | Tzong . | |
| 5,630,745 | 5/1997 | Yeh | 446/390 X |

FOREIGN PATENT DOCUMENTS

| | | | |
|---|---|---|---|
| 343128 | 10/1921 | Germany | 446/374 |
| 382589 | 10/1923 | Germany | 446/370 |
| 456557 | 2/1928 | Germany | 446/370 |
| 123892 | 4/1959 | Russian Federation . | |
| 439697 | 12/1935 | United Kingdom . | |

*Primary Examiner*—John A. Ricci
*Attorney, Agent, or Firm*—Dorr, Carson, Sloan & Birney, P.C.

[57] ABSTRACT

A doll having a natural appearance, a natural feel, and natural motion has an internal support system covered by a flexible integument. The support system has a forward section corresponding to a shoulder girdle and a rearward section corresponding to a pelvic girdle. The forward section and the rearward section are connected by a first component that is flexible in range but not in scope. Forward limbs are attached to the forward section and rearward limbs are attached to the rearward section. A plurality of components comprising a second (straight) component, a third (hinge joint) component, and a fourth (ball-and-socket joint) component are used for other portions of the support system.

19 Claims, 12 Drawing Sheets

Fig. 4(a)
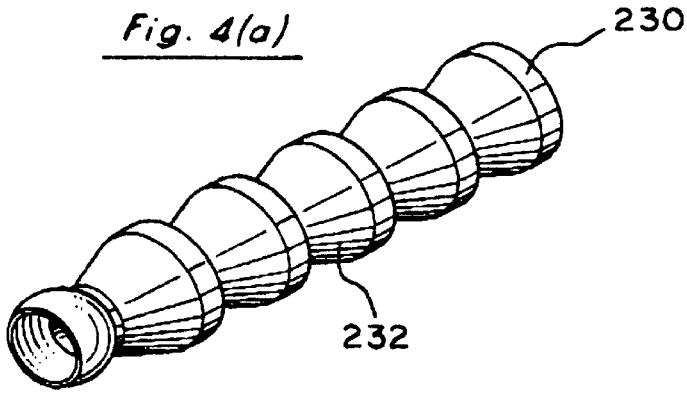
Fig. 4(b)
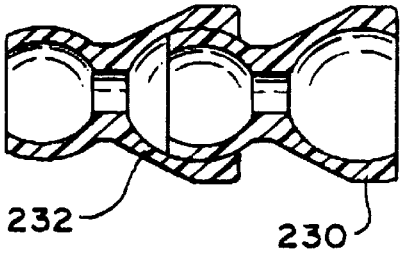
Fig. 4(d)
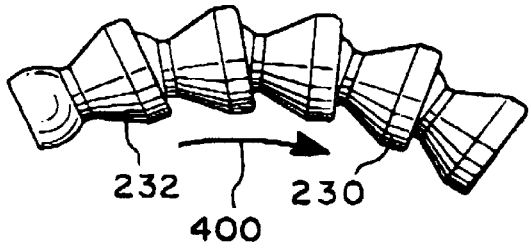
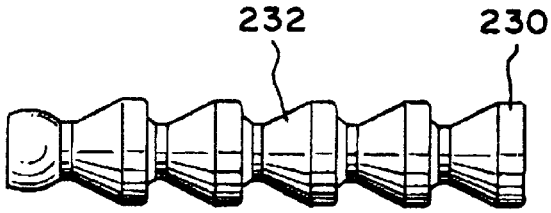
Fig. 4(c)

490
12
12

50
470
40
700
40
260
260
50
40
14
50
230
50
20
260
260
20
40
40
40
50
50
50
30
480
30
30
60

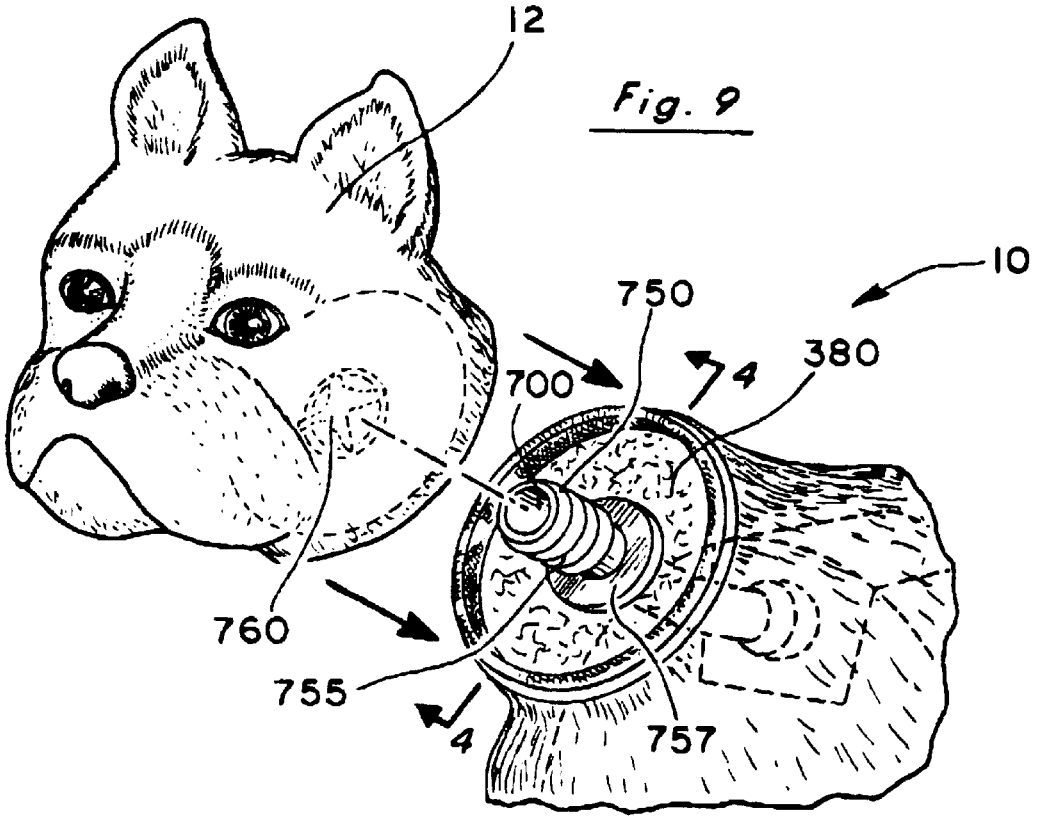
Fig. 9
Fig. 10
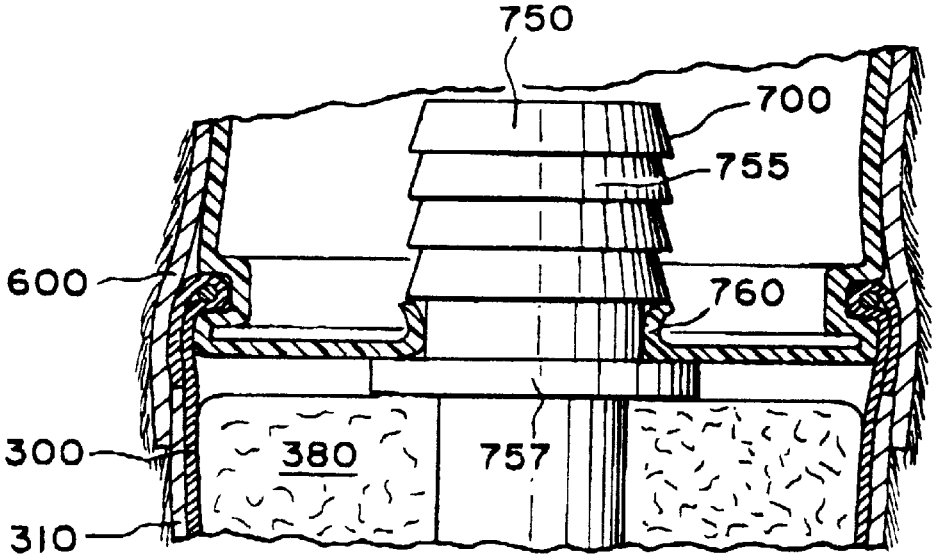

SUPPORT SYSTEM AND FLEXIBLE INTEGUMENT FOR DOLLS

RELATED APPLICATION

This application claims the benefit of U.S. Provisional Application No. 60/055,703, filed Aug. 14, 1997.

BACKGROUND OF THE INVENTION

1. Field of the Invention

This invention relates to dolls and, in particular, to a support system and flexible integument that provide a natural feel, natural range of motion, and natural appearance in dolls and stuffed animals.

2. Statement of the Problem

In the past, many attempts have been made to construct dolls and stuffed animals that are as realistic and natural as possible in both their appearance and ability to assume true-to-life positions and have their limbs moved through the same range of motion that is available to living creatures. For example, one type of doll or toy animal in the prior art, the "action figure," is generally made wholly of a substantially stiff plastic. In this type of figure, the figure is not cast as a whole, but various portions of the figure such as the lower limbs, the upper limbs, the feet, the body, and the head are first manufactured separately, and then connected together to form the entire figure. The connection points form the joints of the limbs, and the limbs are thus enabled to move and assume various positions.

In most of these action figures, therefore, the joints are highly visible on the surface of the limbs, which is unattractive and unrealistic. Furthermore, many of the joints, such as the shoulder and hip joints, do not provide a fully natural range of motion. In a human being, for example, the arm can both rotate through a 360-degree circle around the shoulder and through a 180-degree arc from a position along the side of the body to a position extending directly out from the shoulder parallel to the ground and finally to a position in which the arm is raised above the head. In the action figure dolls, in contrast, the arms usually are attached to the body in such a manner that they can only perform a 360-degree rotation about the joint, and are incapable of being raised away from the body.

In addition to the lack of a full range of motion for its limbs, the action figure has an entirely unnatural feel when handled. Rather than the somewhat soft and yielding feel of a living being's body, the action figure is hard and unyielding.

In order to provide a doll or toy animal with a more natural feel, dolls and toy animals have been made entirely of fabric stuffed with batting or other substances. These dolls and toy animals, often called "rag dolls" or "bean bag dolls" or "stuffed animals," do provide a somewhat more realistic feeling when held or touched. A disadvantage that arises when the entire doll or toy animal is made of fabric is the ability of the limbs of the dolls or toy animals to be moved into both natural and unnatural positions. Sometimes such dolls or toy animals are sewn into a single, fairly stiff position that cannot be changed. At other times, the limbs are floppy, lacking support, so that these dolls or toy animals cannot be posed for any period of time in a particular position.

A need exists to provide dolls and stuffed animals with a more natural feel, appearance, and movements than presently exist in conventional dolls and stuffed animals.

SUMMARY OF THE INVENTION

The present invention comprises a doll having a natural feel, a natural appearance, and natural movements. Dolls of the present invention comprise both human and animal representations. The doll usually has a head attached to a body. At least one forward limb and at least one rearward limb are also attached to the body. The doll contains a support system extending throughout the body and limbs. The support system enables the doll to be moved in predetermined ranges of movements and thus positioned in poses that are obtainable by living beings. The support system prevents the doll from being positioned in poses that are not obtainable by the living being that is represented by the doll. The support system also enables the doll to maintain the selected pose until it is changed.

The support system is comprised of a forward section proximal to the head and a rearward section distal to the head. The forward section and rearward section correspond to the shoulder girdle and pelvic girdle, respectively, of living beings. The forward section and rearward section are generally rigid.

The forward section and the rearward section are connected by a flexible first component (the "backbone" component) that extends between the two sections. This first component provides motion that is unlimited in range but limited in scope. At least one forward limb and one rearward limb are pivotally connected to the forward section and the rearward section respectively. The forward and rearward limbs have an upper portion and a lower portion. The forward and rearward limbs contain a second component that is generally straight and stiff (the "straight" component). Each limb generally contains a straight component in its upper portion and another straight component in its lower portion. The two straight components are attached to a third component that acts as a hinge joint. The forward and rearward limbs are attached to the forward section and the rearward section by a fourth component that acts as a ball-and-socket joint.

Covering the support system and providing a natural feel to the doll is a flexible integument having both elasticity and resiliency. These properties of the flexible integument permit the doll of the present invention to be moved in a predetermined range of motions or posed in various natural positions with minimal bunching of the flexible integument.

These and other advantages, features, and objects of the present invention will be more readily understood in view of the following detailed description and the drawings.

BRIEF DESCRIPTION OF THE DRAWINGS

FIG. 4A is a perspective view of a portion of a first component of the present invention.

FIG. 4B is a cross-section of the first component illustrated in FIG. 4A.

FIGS. 4C and 4D are side views of the first component of FIG. 4A.

FIG. 9 is a perspective view of a portion of a doll showing the connector component of the present invention.

FIG. 10 is a partial cross-section of the neck region of the doll of FIG. 9 showing the connector component and flexible integument of the present invention.

DETAILED DESCRIPTION OF THE INVENTION

Overview

The invention described herein uses a combination of a support system and a flexible integument to provide a natural feel, a natural appearance, and natural motion to dolls and stuffed animals, so that the limbs of the dolls and stuffed animals can be placed in positions that reflect a predetermined range of movements that a human being or an animal can achieve, while avoiding unnatural positions. Each part of the invention is discussed in detail below, and the overall description follows.

Figure 1:
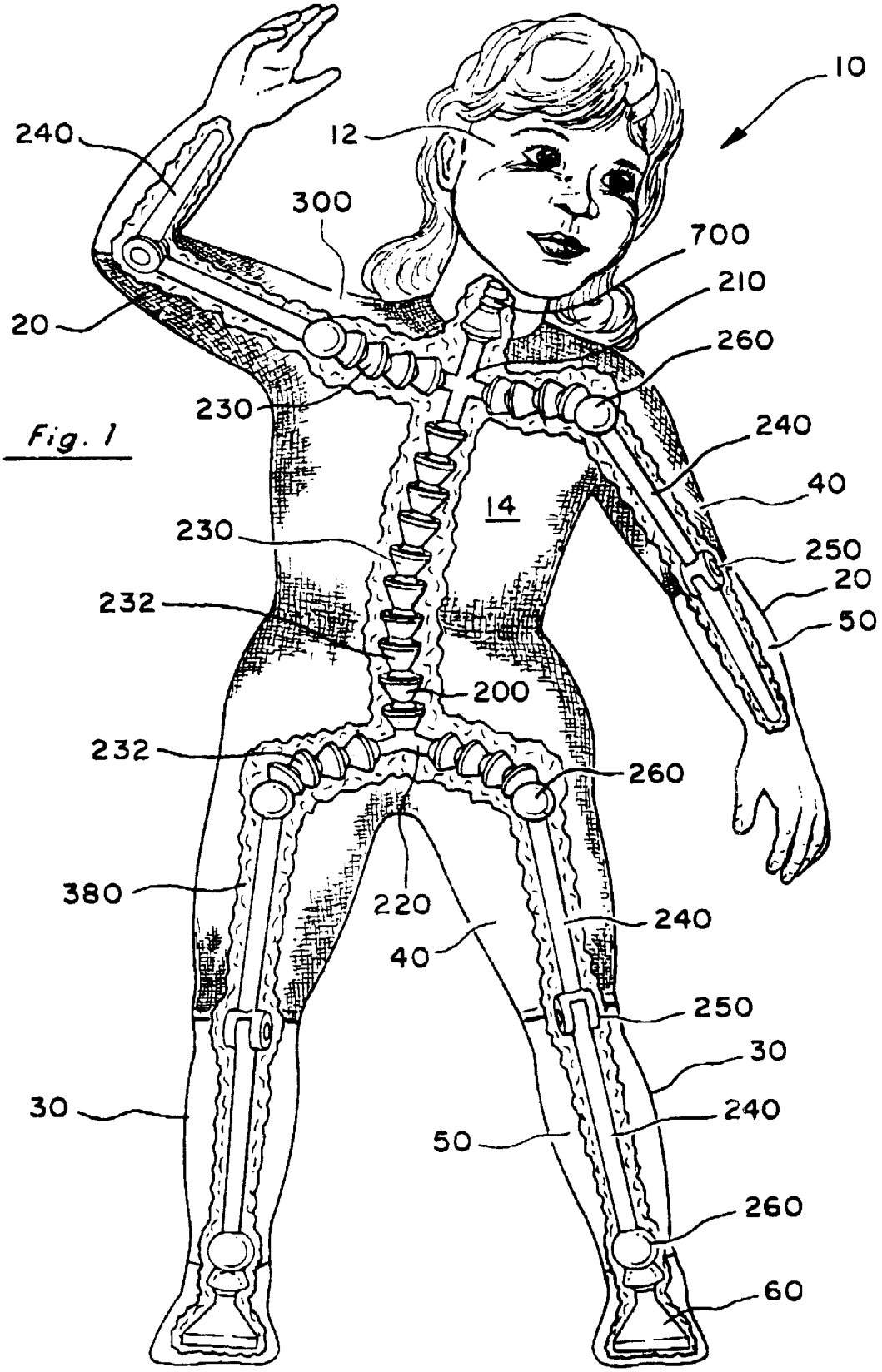
FIG. 1 is a partial cutaway front view of a doll representing a human and comprising the support system and flexible integument of a first preferred embodiment of the present invention.
Figure 2:
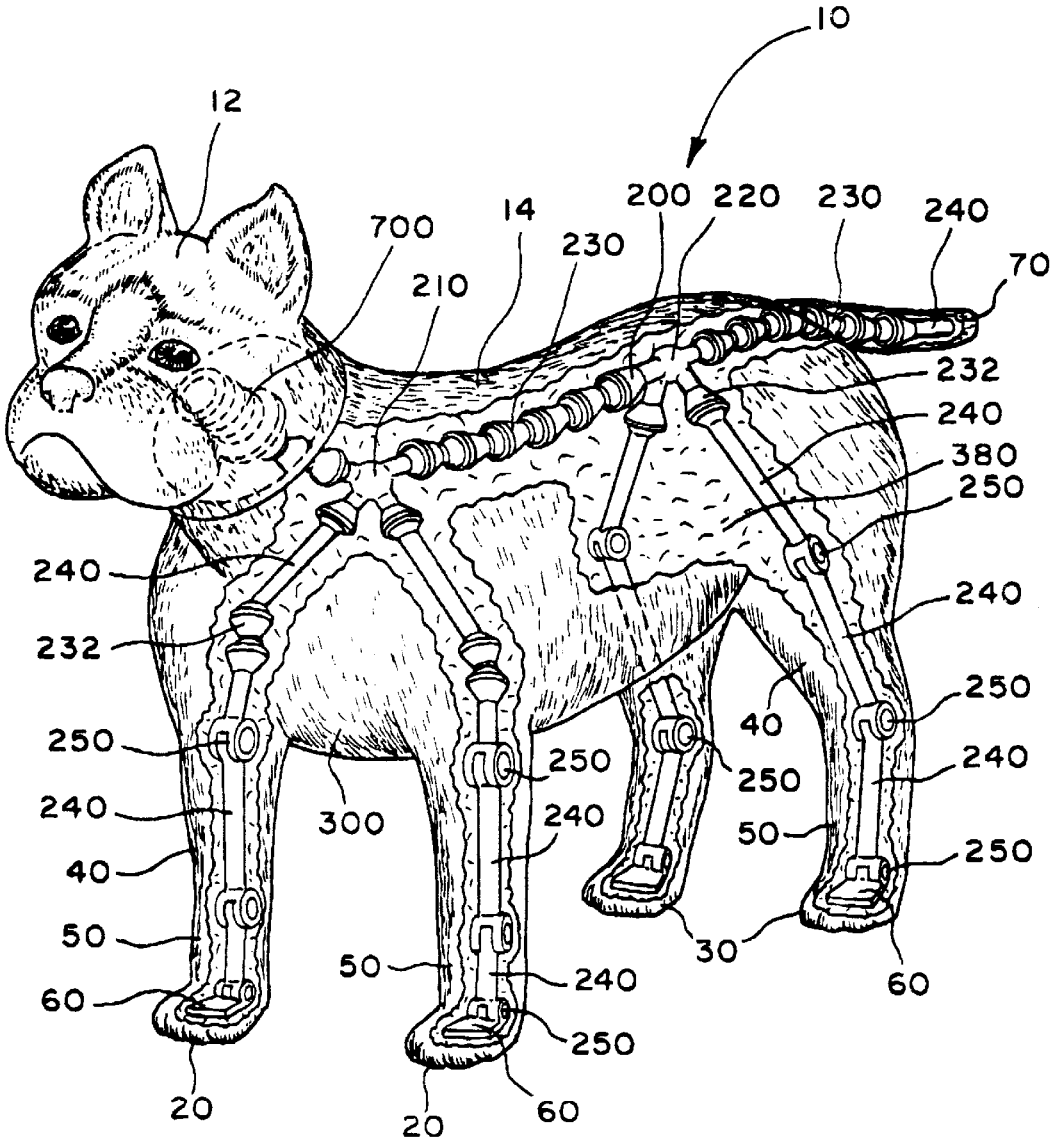
FIG. 2 is a partial cutaway perspective view of a doll representing a dog and comprising the support system and flexible integument of a first preferred embodiment of the present invention.

An example of a doll 10 of the present invention is illustrated in FIG. 1. The doll 10 shown in FIG. 1 has a human shape, but dolls 10 having the shapes of animals are meant to be included in the present invention, and such a doll 10 representing a dog is illustrated in FIG. 2. The term "dolls" in the following specification refers to both animal and human representations.

The doll 10 of the present invention as illustrated in FIG. 1 comprises a head 12 attached to a body 14. At least one forward limb 20 and at least one rearward limb 30 are attached to the body 14. Each forward limb 20 and each rearward limb 30 has an upper portion 40 and a lower portion 50. Within the body 14 and limbs 20, 30 is placed a support system 200. Stuffing material 380 is disposed around the support system 200. The support system 200 is hidden from view by a flexible integument 300 covering the body 14 and limbs 20, 30.

Support System

Figure 3:
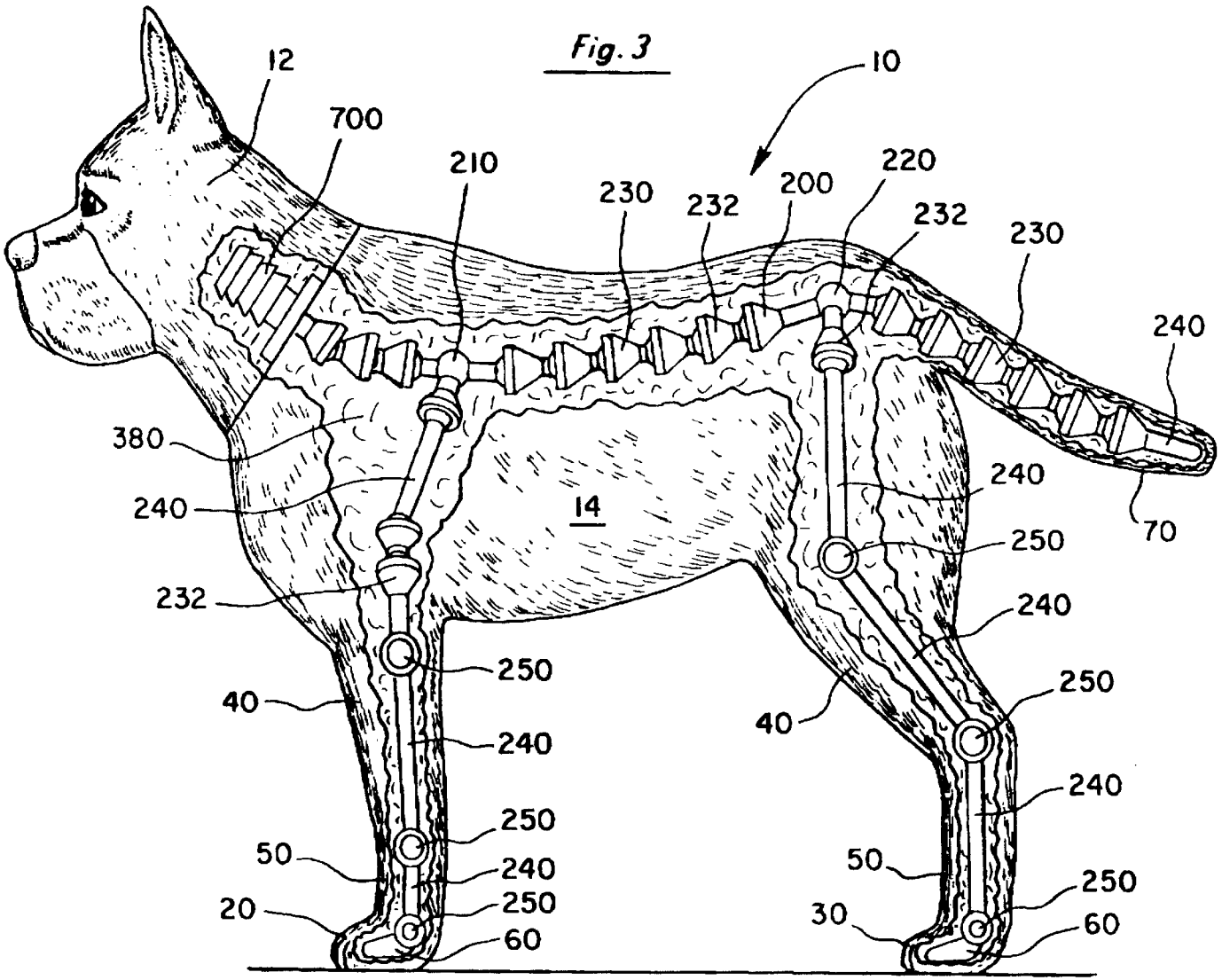
FIG. 3 is a partial cutaway side view of the doll of FIG. 2.

The support system 200 of the present invention provides a doll 10 with a realistic and natural range of motion. The range of motion provided by the support system 200 is predetermined and is based on the range of motion achievable by living animals and humans. This is accomplished by the use of a support system 200 having a plurality of components. Examples of dolls 10 containing a support system 200 according to a first preferred embodiment of the present invention are shown in FIGS. 1, 2, and 3. It should be understood that the support system 200 of the present invention is capable of being used with dolls of any shape, especially dolls that represent the human figure, as illustrated in FIG. 1, and dolls that represent animals, as illustrated in FIGS. 2 and 3, and with jointed limbs whether or not used with other doll elements, and that use of the support system 200 of the present invention with dolls representing any type of living being is contemplated under the teachings of this disclosure.

Turning to FIG. 1, it can be seen that, in a first preferred embodiment, the components of the support system 200 are found within the interior of the doll 10 and are completely hidden by an outer covering. The outer covering is preferably a fabric forming a flexible integument 300 covering all of or portions of the doll 10. A stuffing material such as POLYFILL™ (see material 380 in FIGS. 1 and 2) is first disposed around the support system 200 and then covered with the flexible integument 300 such that no portion of the support system 200 is exposed to the exterior. This avoids the problem discussed hereinabove in the prior art where joints are often highly visible on the exterior surfaces of movable dolls.

A forward section 210 of the support system 200 is placed within the body 14 proximal to the head 12 and acts as a shoulder girdle. A rearward section 220 of the support system is placed within the body 14 distal to the head 12 and acts as a pelvic girdle. The forward section 210 and the rearward section 220 are generally rigid; however, if flexibility of the forward section 210 and the rearward section 220 is desired, such flexibility can be achieved with a first component 230 as described below. A variety of shapes are contemplated for the forward section 210 and the rearward section 220 under the teachings of the present invention. Any shape that provides the necessary structural support, along with attachment areas for the other components, is acceptable in the present invention. For example, as shown in a first preferred embodiment in FIGS. 1 and 2, the forward section 210 can have a four-prong shape (as shown in FIG. 1 for the shoulder girdle of the human doll 10 and in FIG. 2 for the shoulder girdle of the dog doll 10) and the rearward section 220 can have either a three-prong shape (as shown in FIG. 1 for the pelvic girdle of the human doll 10) or a four-prong shape (as shown in FIG. 2 for the pelvic girdle of the dog doll 10). In a second preferred embodiment, shown in FIGS. 5 and 6, moderately flexible foam rubber or plastic shell pieces 210, 220 are cut into substantially semicircular shapes and then placed at locations corresponding to the shoulder girdle and pelvic girdle of the animal being represented.

The forward section 210 and the rearward section 220 are attached together by a first component 230 that extends between the forward section 210 and the rearward section 220 and acts as a backbone. The first component 230 (which is sometimes referred to in this specification as the backbone component 230) is illustrated in more detail in FIGS. 4A–4D. The first component 230 of the present invention can be used when it is desired to provide a portion of a doll 10 with motion that is unlimited in range but limited in scope. That is to say that the first component 230 can be flexed in any direction desired (the "range"), but that the total distance moved (the "scope") in that range is predetermined and is limited to, for example, about 10 degrees to about 60 degrees from the default straight position shown in FIGS. 4A and 4C, as illustrated by arrow 400 in FIG. 4D. The first component 230 can be placed in dolls 10 in a position corresponding to, for example, the spine of a living organism. Other positions for the first component 230 are contemplated by the teachings of the present invention. For example, the first component 230 can be located so that it is in the position to act as a tail for the doll 10, as illustrated in FIGS. 2 and 3.

The scope of the movement of the first component 230 can vary as desired depending on the type of doll. For example, in dolls representing humans, a more limited scope of movement in the first component 230 (that is, in the "backbone"), such as about 10 degrees to about 15 degrees, is desirable than in dolls representing, for instance, cats or snakes, in which the scope of movement could be as much as about 45 degrees to about 60 degrees. Furthermore, the scope of movement of the first component 230 can vary within a single doll, for example, a monkey, to provide a less flexible backbone and a more flexible tail. Such variations in the scope are predetermined by the construction of the first component 230 based upon the nature of the doll 10.

In a first preferred embodiment, the first component 230 is formed of a plurality of first modules 232 attached end to end, as illustrated in FIGS. 4B and 4C. The first modules 232 of the first component 230 are limited in the degree to which they can move with respect to each neighboring module 232. Each first module 232 can bend approximately 20 to 30 degrees with respect to its neighbor. To achieve a wider range of motion, more than one first module 232 of the first component 230 can be bent at one time, as illustrated by arrow 400 in FIG. 4D. When several of the first modules 232 are bent to obtain a wider range of motion, a smooth curve results extending over several centimeters (as shown in FIG. 4D).

Figure 5:
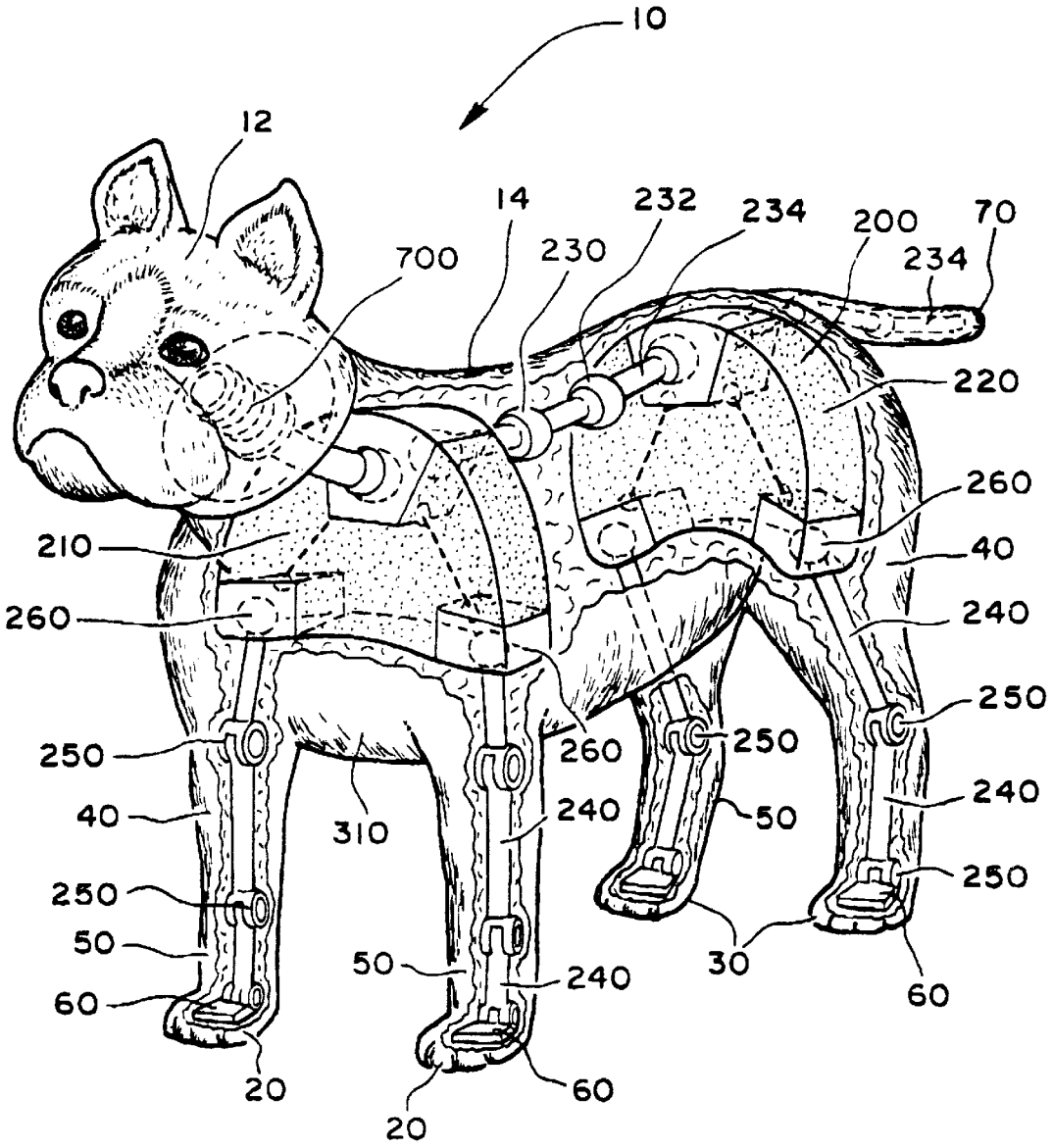
FIG. 5 is a partial cutaway perspective view of a doll representing a dog and comprising the support system and flexible integument of a second embodiment of the present invention.
Figure 6:
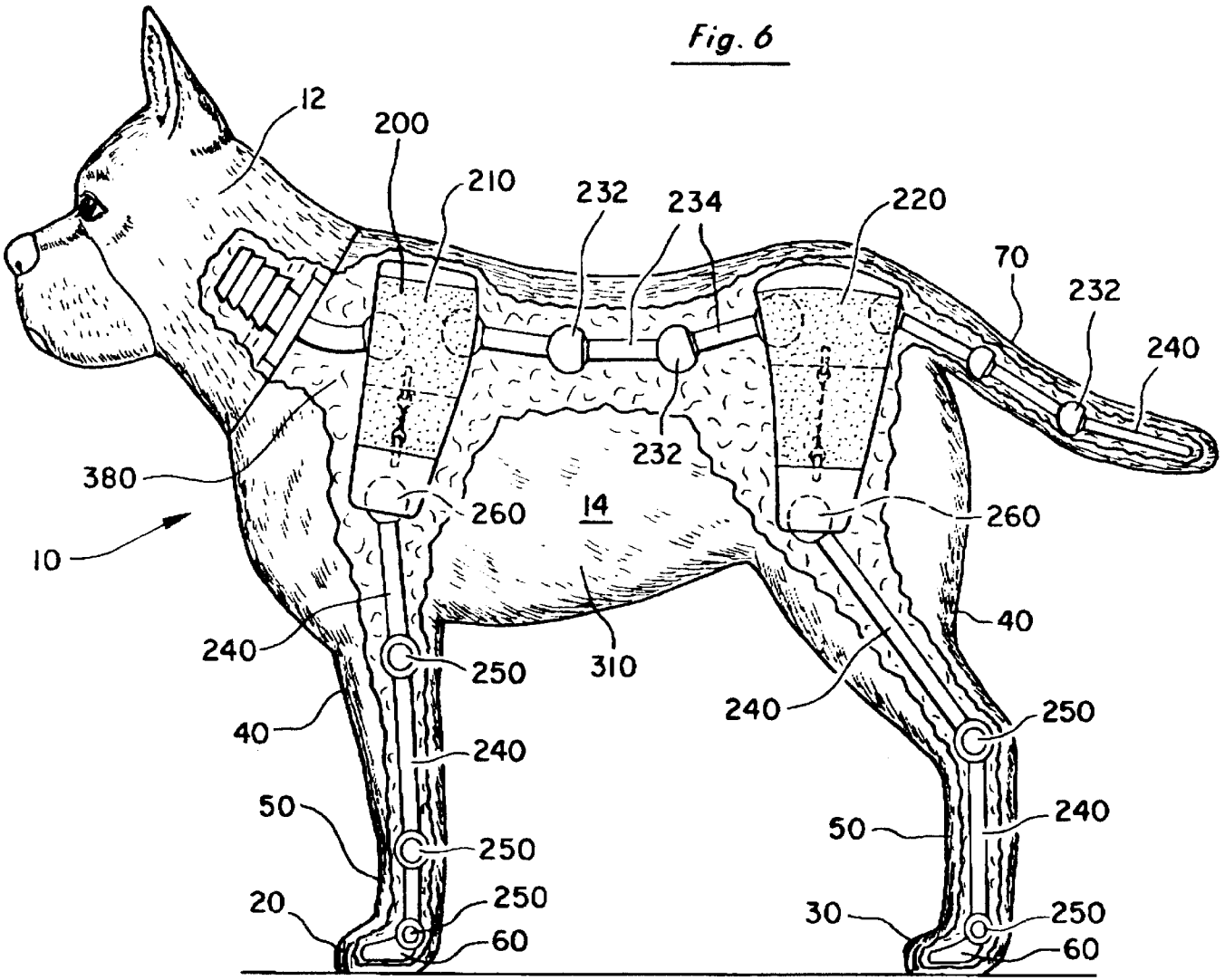
FIG. 6 is a partial cutaway side view of the doll of FIG. 5.

In a second preferred embodiment of the first component 230 illustrated in FIGS. 5 and 6, the first component 230 comprises a series of first modules 232 each separated by a short length of a second module 234, as can be most easily seen in FIG. 6. The first modules 232 in this second preferred embodiment are preferably ball-and-socket joints. Other constructions of the first component 230 are contemplated under the teachings of the present invention (not illustrated) The first component 230 may, for example, comprise a series of hinge joints, or a series of ball-and-socket joints connected with shorter lengths of intervening second modules 234 than are shown in FIGS. 5 and 6. This latter type of construction may be used when more flexibility is desired, as in the tail of a cat or monkey doll.

When it is desired to provide more flexibility to the forward section 210 and the rearward section 220, the first component 230 can be attached to these sections 210, 220 in locations other than as a "backbone." For example, FIG. 1 shows a first component 230 comprising four first modules 232 attached to either side of the forward section 210 proximal to the forward limbs 20. Although four first modules 232 are shown in FIG. 1, as few as one or two first modules 232 can be used, as illustrated in FIG. 2, or as many as six first modules 232 can be used (not illustrated). These first modules 232, when attached to the forward section 210, can provide additional flexibility in the manner of a "collarbone," allowing a human doll 10 to, for example, be placed in a position corresponding to a shrug. Similarly, the first component 230 can be attached to the rearward section 220 in a position corresponding to the hips of a living being to provide more flexibility in that area of the doll 10.

A second component 240 of the support system 200 is a straight, nonflexible piece 240 of variable length. The second component 240 is also referred to in this specification as the "straight" component 240. The straight component 240 can be positioned so that, for example, it extends along the upper 40 and lower 50 portions of the limbs 20, 30. Other positions for the straight component 240 could be as a part of a tail, as illustrated in FIGS. 2 and 3, or as part of the backbone component 230 instead of using the second modules 234 (not illustrated).

A third component 250, or "hinge" component 250, acts as a hinge joint, and a fourth component 260, or "ball-and-socket" component 260, serves as a ball-and-socket joint.

Various combinations of these sections 210, 220 and components 230, 240, 250, 260 are used in dolls 10 to provide realistic motions to the limbs 20, 30, head 12, and body 14. For example, in the human doll 10 illustrated in FIG. 1, the second component 240 (the "straight" component 240) is used in the forward limbs 20 and rearward limbs 30 in portions 40, 50 of these limbs 20, 30 where no motion or bending is seen in human beings. That is, the straight component 240 could be used for portions of the support system 200 corresponding to the humerus and ulna in the arm 20 and to the femur and tibia in the leg 30. For a more natural look, the straight components 240 in the rearward limbs 30 may be longer than the straight components 240 in the forward limbs 20. In the dog doll 10 illustrated in FIGS. 2 and 3, the straight component 240 is used in the forward 20 and rearward 30 limbs in the portions 40, 50 of the limbs 20, 30 where no motion or bending is seen in living beings. In general, as shown in FIGS. 1, 2, and 3, these parts of the dolls 10 will generally correspond to the upper 40 and lower 50 portions of the limbs 20, 30.

Either a third component 250 (the "hinge" component 250) or a fourth component 260 (the "ball-and-socket" component 260) can be placed between two straight components 240 or between a straight component 240 and a forward 210 or rearward 220 section. The hinge component 250 can be used at locations where a joint is needed that has a range of motion limited to no more than approximately 180 degrees in a single predetermined direction, for example, at a position corresponding to an elbow or knee joint in the living organism. The ball-and-socket component 260 can be used in locations where a more circular predetermined range of motion must be provided, such as those locations corresponding to shoulder, hip, ankle, or wrist joints, for example.

Examples of the use of the hinge components 250 and ball-and-socket components 260 are shown in FIGS. 1, 2, and 3. For example, in the dolls 10 illustrated in FIGS. 1, 2, and 3, a hinge component 250 is placed between the straight components 240 in the upper 40 and lower 50 portions of the forward limbs 20 and rearward limbs 30. In the doll 10 illustrated in FIG. 1, a ball-and-socket component 260 is located in the "shoulder" where the upper portion 40 of the forward limb 20 attaches to the forward section 210. Another ball-and-socket component 260 is positioned where the upper portion 40 of the rearward limb 30 is attached to the body 14 at the rearward section 220. Another ball-and-socket joint 260 is place at the end of the lower portion 50 of the rearward limb 30 where the foot 60 is attached. In comparison, in the dog doll 10 illustrated in FIGS. 2 and 3, one or more modules 232 of the first component 230 are used for the "shoulder" and "hip" joints since those joints in a dog are less mobile than they are in a human, and the first component 230 provides a more restricted range of motion than the ball-and-socket component 260.

It is an important aspect of the present invention that all of the sections 210, 220 and components 230, 240, 250, 260 are modular in nature. That is, for example, all hinge components 250 used in an elbow joint of one type of doll 10, such as a human doll, are identical, all hinge components 250 used in a knee joint are identical, and all hinge components 250 in an ankle joint (in animal dolls) are identical. Similarly, all ball-and-socket components 260 used in shoulder and hip joints are identical, whereas those ball-and-socket components 260 used for the ankles and wrists (in human dolls) are smaller than the ball-and-socket components 260 used for the shoulder and hip. The straight components 240 can all be of identical length or, alternatively, a plurality of particularly specified lengths can be used to provide a more realistic appearance as described above. This modularity makes it very easy to manufacture the sections 210, 220 and components 230, 240, 250, 260 and results in considerable cost savings. The fact that the sections 210, 220 and components 230, 240, 250, 260 are modular also makes it easy for workers to quickly assemble with a limited number of sections 210, 220 and components 230, 240, 250, 260 a wide variety of different support structures 200 corresponding to different doll embodiments, including human and animal representations.

The sections 210, 220 and components 230, 240, 250, 260 are, in a preferred embodiment, attached together in desired combinations by using an interlocking modular system (not shown) that is identical for all the sections 210, 220 and components 230, 240, 250, 260, enabling any one of the sections 210, 220 and components 230, 240, 250, 260 to be attached to any other one of the sections 210, 220 and components 230, 240, 250, 260 or to other parts of the system such as connectors 700 attaching the head 12 to the body 14 (see FIG. 9). The interlocking system can be used, in a first preferred embodiment, to attach the sections 210, 220 and components 230, 240, 250, 260 together immediately after the sections 210, 220 and components 230, 240, 250, 260 are formed, while they are still hot from the casting process and thus somewhat soft and flexible. When the sections 210, 220 and components 230, 240, 250, 260 later cool and harden, the interlocking system becomes irreversible, providing a strong connection and preventing the sections 210, 220 and components 230, 240, 250, 260 from inadvertently separating during movement of the joints. In a second preferred embodiment, the interlocking modular system uses a specially formed jig that mechanically maintains the correct positional relationship between the sections 210, 220 and components 230, 240, 250, 260 during assembly. It is to be understood that the sections 210, 220 and components 230, 240, 250, 260 can also be attached together by conventional methods that will be known to those skilled in the art, for example, by snapping the end of the straight component 240 into a formed socket on the hinge component 250 or ball-and-socket component 260. Such other conventional methods of attaching the sections 210, 220 and components 230, 240, 250, 260 together will be obvious to those skilled in the art, and such other methods for attachment are contemplated under the teachings of the present invention.

Figure 7:
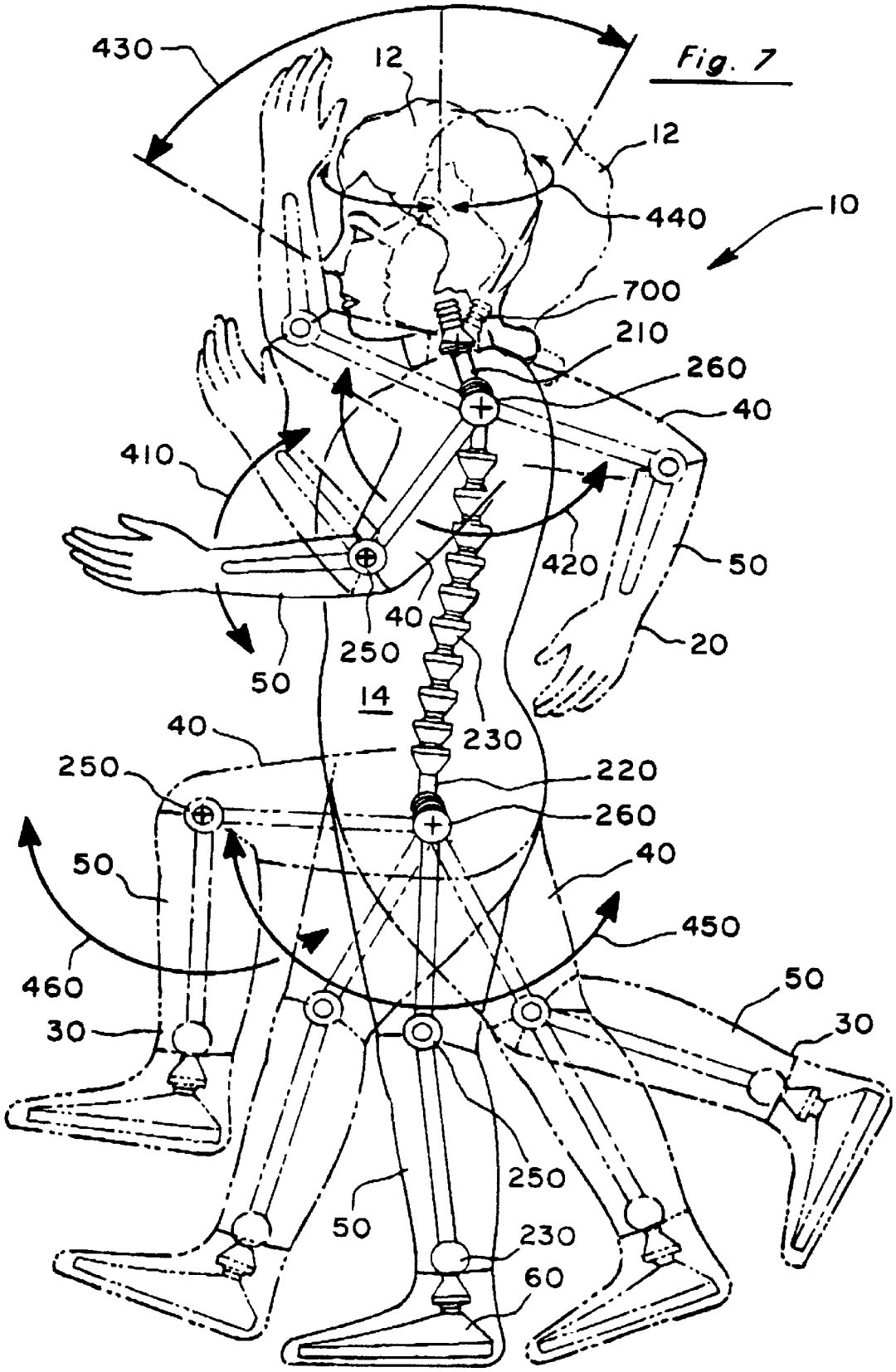
FIG. 7 is a side view of a doll illustrating the range of certain predetermined movements.
Figure 8:
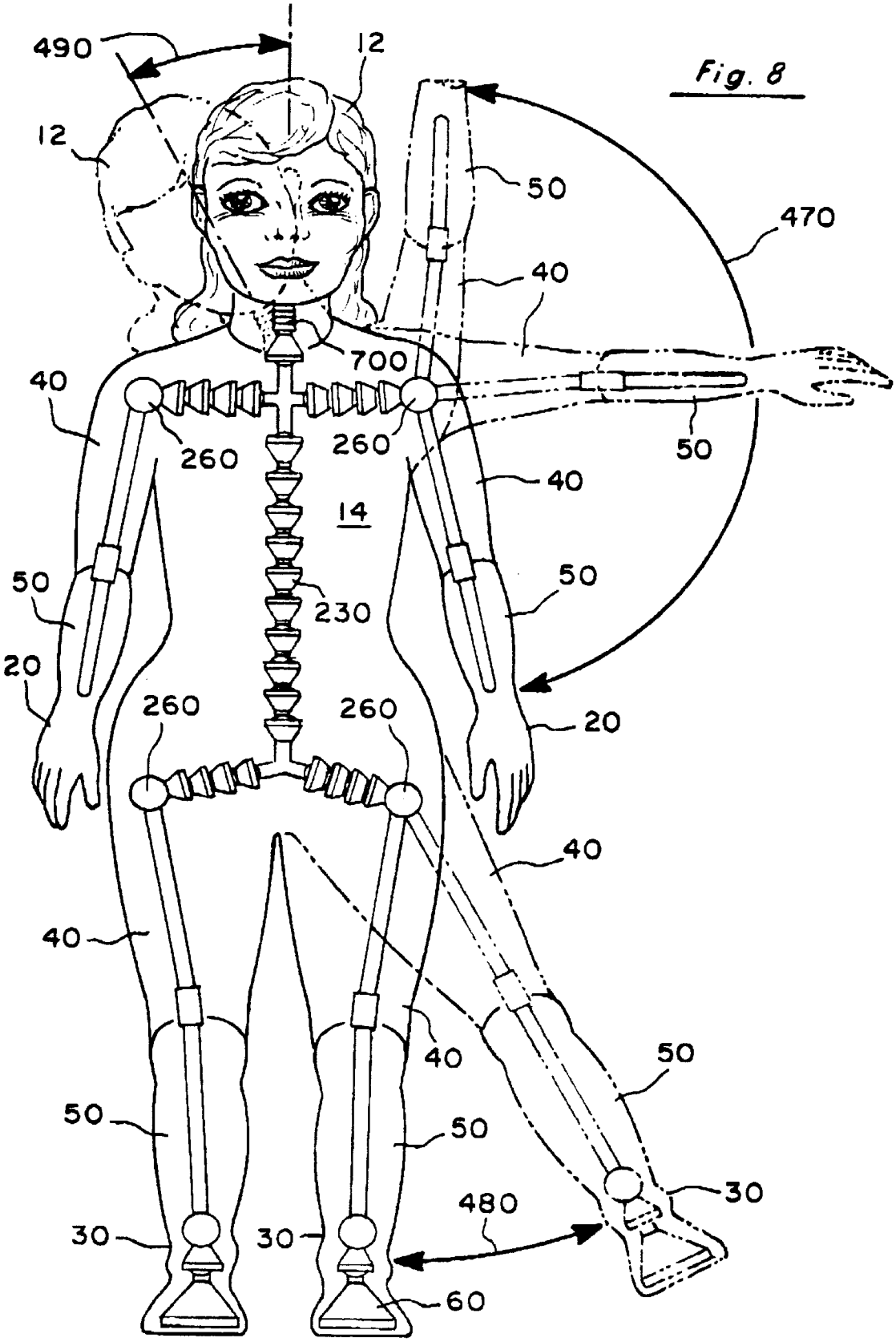
FIG. 8 is a front view of a doll illustrating the range of certain predetermined movements.

It is important to the present invention that the combinations of sections 210, 220 and components 230, 240, 250, 260 provide a predetermined range of motion that is predicated on the range of motion that can be achieved by the living organism that the doll 10 represents. Thus, unnatural movements are not likely to occur in dolls 10 containing such sections 210, 220 and components 230, 240, 250, 260. For example, FIGS. 7 and 8 illustrate certain predetermined ranges of motion of a doll 10 representing a human. In this doll 10, for instance, the components 240, 250 forming the forward limb 20 can be moved in a first predetermined direction indicated by arrow 410. Here, the lower portion 50 of the forward limb 20 can only be moved in the first predetermined direction for a first predetermined number of degrees, that is, about 180 degrees, toward the upper portion 40 of the forward limb 20. Similarly, the components 240, 250 forming the rearward limb 30 can be moved in a second predetermined direction indicated by arrow 430. Here, the lower portion 50 of the rearward limb 30 can only be moved in a second predetermined direction for a second predetermined number of degrees, that is, about 180 degrees, toward the upper portion 40 of the rearward limb 30.

The forward limb 20 can also be moved in predetermined range, that is, a 360-degree rotation around the ball-and-socket component 260 between the forward section 210 and the upper portion 40 of the forward limb 20, as illustrated by arrow 420 in FIG. 7. In addition, the forward limb 20 can be moved in an arc of about 180 degrees from a position alongside the body 14 to a position above the head 12, as shown by arrow 470 in FIG. 8.

The head 12 of the doll 10 comprises a predetermined range of motions illustrated by arrows 430 and 440 in FIGS. 7 and by arrow 490 in FIG. 8. That is, the head 12 can be tipped toward the front or rear of the body 14 as indicated by arrow 430 in FIG. 7 over a range of about 145 degrees. In addition, the head 12 can be moved to each side as indicated by arrow 490 in FIG. 8 over a range of about 100 degrees. The head can be rotated in a 360-degree range as indicated by arrow 440 in FIG. 7. Finally the head 12 of a doll 10 can be turned from side to side with relation to the body 14 (not shown) over a range of about 180 degrees.

The upper portion 40 of the rearward limb 30 can be moved as indicated by arrow 450 in FIG. 7 and arrow 480 in FIG. 8. That is, the upper portion 40 of the rearward limb 30 can be moved as indicated by arrow 450 forward about 180 degrees and can be moved backward about 60 degrees, for a total range of movement forward and backward of about 240 degrees. The upper portion 40 of the rearward limb 30 can also move to the side about 65 degrees, as indicated by arrow 480 in FIG. 8.

It is important to the present invention that the support system 200, while providing a predetermined natural range of motion, also enables the doll 10 to maintain a particular position or pose once the doll 10 is moved into that position or pose. This "poseability" is provided by supplying the support system 200 described above with a predetermined amount of friction, so that the components 230, 240, 250, 260 of the support system 200, once moved, maintain their position until moved again. The predetermined amount of friction is such that the components 230, 240, 250, 260 can be easily moved but sufficient friction exists so that the component 230, 240, 250, 260 will be able to support the weight of the doll 10 in the chosen position and also be able to resist the resiliency of the flexible integument 300. Because of its resilient properties, the flexible integument 300, once stretched by the motion of an underlying component, tends to return to its original, default position. The predetermined amount of friction of the support system 200 is sufficient to resist this resilience of the flexible integument 300.

At desired positions, a connector 700 can be attached by the modular interlocking system of the present invention (or by a conventional method) to the sections 210, 220 and the components, 230, 240, 250, 260 of the support system 200 to provide an attachment point for other parts of the doll such as the head 12 or foot 60 or tail 70. An example of a connector 700 attached to the forward section 210 is shown FIGS. 1–5. The connector 700 can be attached directly to the forward section 210, as shown in FIGS. 1, 4, and 5, or the first component 230 can be placed between the connector 700 and the first section 210 if more flexibility is desired in the neck, as shown in FIGS. 2 and 3. The connector 700 is illustrated in more detail in FIGS. 9 and 10. In this preferred embodiment, the connector 700 comprises a largely cylindrical male portion 750 having a series of detents 755 on its exterior surface, with a flange 757 extending from the connector 700. A modular interlock (not shown) is located at the end of the connector 700 for attachment of the connector 700 to a section 210, 220, or a component 230, 240, 250, 260 of the support system 200, such as the forward section 210 as illustrated in FIG. 1 or the first component 230 as illustrated in FIGS. 2 and 3. A female element 760 corresponding to the male portion 750 is located on the head 12 or other part that is to be attached. To connect the head 12 to the body 14, for example, the female element 760 is slipped over the male element 750 until it is stopped by the flange 757, as can be seen in more detail in FIG. 10. The detents 755 then act to prevent the attached part from being detached without the action of considerable force. It is to be understood that the present invention is not limited to the description of the connector 700 found herein and that other conventional attachment systems are contemplated under this disclosure. For example, portions of the dolls 10 can be connected by gluing or soldering the parts, or by other attachment systems that are known to those skilled in the art.

Flexible Integument

An important aspect for providing a natural appearance, natural feel and natural range of motion to dolls involves the use of an outer covering, or integument, that reflects the properties of the skin of the living being. Among these properties, those of most interest to the present invention are the properties that permit a wide range of motion, that is, elasticity and resiliency. Elasticity is the ability to resist deformation by stretching, and resiliency implies the ability to recover to the original shape after the deforming influence is removed.

Previous embodiments of dolls have been constructed with fabric bodies, often including all of or portions of the limbs, to provide a soft and more true-to-life feel to the touch. These fabric bodies are often made of a cotton cloth or cotton/polyester blend. Such fabric bodies have the advantages of being inexpensive and easy to manufacture, and can be constructed in nearly any shape desired. When conventionally stuffed with batting, the fabric also permits a certain amount of movement of the limbs.

However, when dolls with cotton fabric bodies are required to provide a range of motion similar to that available to a living body, the cotton fabric can restrict the full extent of the motion. This occurs when the limb of the doll is moved beyond the point where the fabric can follow. Indeed, when the motion of a limb places tension on the cotton fabric, the fabric not only restricts movement, but it can pull the limb back to the default position. Tension on the cotton fabric can also cause other portions of the doll to move when such movements were not intended. The result is that the limbs of dolls having conventional cotton fabric bodies cannot be placed for any long period of time in positions other than the default position.

Figure 11A:
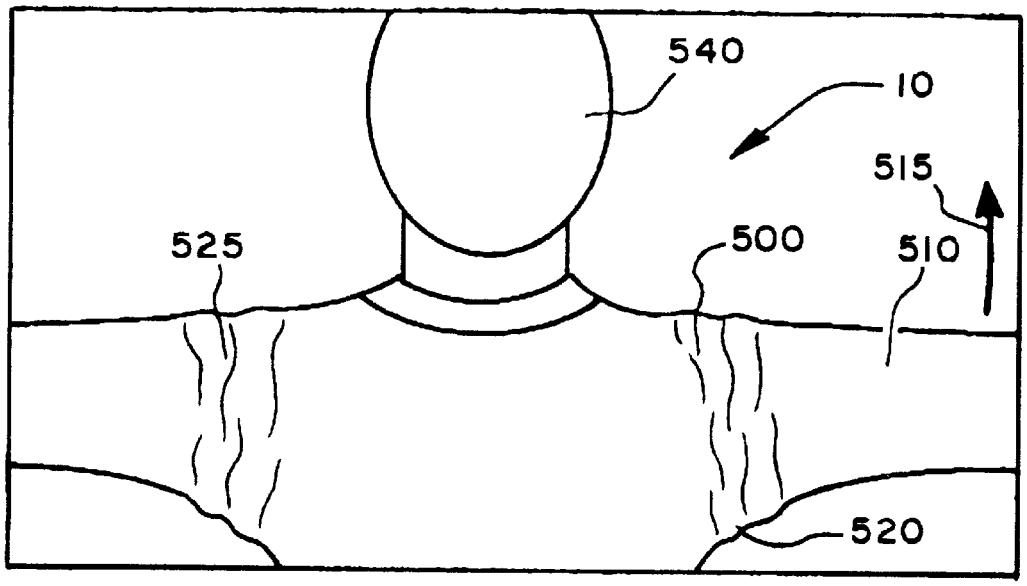
Fig. 11(a) (Prior Art)
FIG. 11A is a front view of a prior art doll with a cloth integument.

For example, by rotating the shoulder joint, human beings can move their arms through a range of about 180 degrees from a position in which the hand points toward the ground to a position in which the hand extends upward and over the head. In a prior art doll 500 representing a human figure and constructed of a cotton fabric body, as illustrated in FIG. 11A, when the arm 510 is lifted 515 at the shoulder joint upward toward the head 540, the fabric restricts the full motion of the arm 510 as the fabric is pulled tight under the armpit 520. Thus, the arm 510 of such dolls 500 cannot rise completely above the shoulder; indeed, the arm 510 cannot rise above a position parallel to the ground. Similar problems occur at the other joints of the body. Thus, the range of motion of the limbs of such dolls is limited by the amount of cotton fabric available in the body of the doll. To remedy this problem, it is possible to provide additional amounts of cotton fabric around the joints 525. However, the additional fabric results in large folds and bulges of excess fabric at the joints when the limb is not bent, which is unattractive and detracts from a realistic appearance. In addition, the excess fabric does not hold the stuffing material firmly, and often allows the stuffing material to migrate, forming unsightly lumps and bulges.

A preferred embodiment of the present invention remedies this problem by providing dolls 10 with an integument 300 that is constructed of a flexible, elastic, and resilient fabric that can stretch in any direction to follow the motions of the body 14 and limbs 20, 30 of the doll 10, yet recover its original shape when the body 14 and limbs 20, 30 are in an extended or default position, enabling the body 14 and limbs 20, 30 to move throughout the full range of natural motions found in the living organism, and enabling the limbs 20, 30 to be placed in a position other than the default position. Such a flexible integument 300 also furnishes dolls 10 with a more natural feel and appearance than a cotton fabric or vinyl covering, while maintaining the advantages of low cost, ease of manufacture, and the ability to be constructed in any desired shape.

Figure 11B:
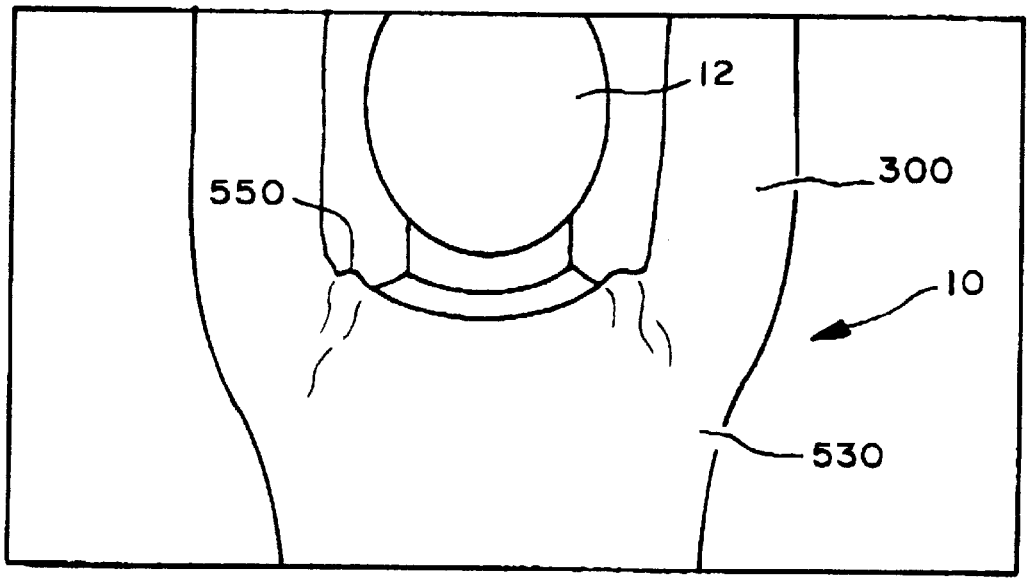
FIGURE 11B is a front view of a doll with a flexible integument according to the teachings of the present invention.

An example of a doll 10 with a flexible integument 300 is illustrated in FIG. 11B. In comparison with the prior art doll 500 having a cotton fabric body as shown in FIG. 11A, the doll 10 shown in FIG. 11B is capable of having its joints positioned throughout the entire range of natural motion, with the flexible integument 300 stretching 530 when necessary to follow the flexing of, for example, a shoulder joint and recovering its shape when the joint is returned to its default position. Because of the elastic properties of the flexible integument 300 that enable it to stretch 530, little excess 550 is necessary to enable a limb to move.

Another example of a doll 10 with a flexible integument 300 is illustrated in FIG. 1. Here, the flexible integument 300 extends over the body 14 of the doll 10 and along the upper portions 40 of the limbs 20, 30. It is to be understood that the flexible integument 300 could extend further along the lower portions 50 of the limbs 20, 30, and indeed along the entire surface of the doll 10, including the feet and head, as illustrated by the dog doll 10 of FIG. 2.

The flexible integument 300 of a preferred embodiment of the present invention can be made of one or several of the conventional elastomeric fabrics that are presently available in commerce, such as, for example, fabrics containing spandex. Spandex is a synthetic fiber made of at least 85% of the polymer polyurethane. While these preferred elastomeric fabrics can be used in the present invention, other known elastomeric fabrics having a particularly desired amount of elasticity and resiliency also can be used in the present invention, as will be obvious to those skilled in the art, and such other elastomeric fabrics are considered to be contained within the scope of the present invention. Examples of such elastomeric fabrics are described in the prior art by Greenwald et al. (U.S. Pat. No. 3,357,076) and Hamilton (U.S. Pat. No. 5,478,514).

The fabrics of Greenwald et al. are stated to have a potential stretch in the range of less than 10% to about 215% longer than the resting length of the fabric, whereas the fabrics described by Hamilton have a potential elastic stretch of 18% to 45%. For the purposes of the present invention, an elastomeric fabric having a potential stretch in all directions of about 0% to about 100% is preferred. That is, if a piece of this preferred elastomeric fabric has a resting length $L_1$, for example, it can be stretched to a longer length, for example, $L_1+100\%L_1=L_2$.

Dolls can be made with the flexible integument 300 covering different portions of their surfaces. In a first preferred embodiment, illustrated by the animal dolls 10 in FIGS. 2 and 3, the flexible integument 300 extends over the entire surface of the head 12, body 14, and limbs 20, 30 of the doll 10, from head to toe. In this first preferred embodiment, the extension of the flexible integument 300 over the entire surface of the doll 10 permits all the joints to obtain their full predetermined range of motion. In a second preferred embodiment, such as that illustrated in FIG. 1, the flexible integument 300 may cover a substantial portion of the doll 10, for example, from the neck over the entire body 14 and extending along the upper limbs 40 to the knee and elbow joints, and the remainder of the limbs 50 may be formed from vinyl or another conventional substance. In this second preferred embodiment, the extension of the flexible integument 300 down to the elbow and knee joints enables these joints to bend naturally at the appropriate location. This is especially important for those dolls 10 discussed below that also have a support system 200 in addition to the flexible integument 300. Prior art dolls often have vinyl arms and legs in which the vinyl extends past the area of the elbow and knee joints and closer to the body. In these dolls, the arms and legs bend in the middle of what is normally a straight and inflexible portion of the limb. Thus, extending the flexible integument 300 to the hinge joint 250 areas of the limbs 20, 30 represents an important advance in providing a realistic doll capable of natural movements. The extension of the flexible integument 300 down the arms 20 of human dolls 10 also provides such dolls 10 with a realistic feel when they are picked up and handled, as most people tend to pick up such dolls 10 by grasping them in the shoulder and upper arm areas.

In a first preferred embodiment, the flexible integument 300 can be smooth, as would be desired for a doll 10 representing a human figure as shown in FIG. 1 or representing a hairless animal such as an amphibian or snake (not shown). In a second preferred embodiment, the flexible integument 300 can be textured, for example, to represent fur or feathers, as would be desired for a doll 10 representing an animal such as the dog shown in FIGS. 2 and 3. The flexible integument 300 can be left exposed, as would be desired for a doll 10 representing a human figure as shown in FIG. 1, or the flexible integument 300 can be covered with a second flexible integument 310 having fur or other textured material attached on the outside, as would be desired in the case of an animal doll. In the latter case, as shown in FIG. 6 and in more detail in FIG. 10, the first flexible integument 300 is substantially tightly stuffed, and the second flexible integument 310 is slightly larger than the first integument 300, so that the second integument 310, when drawn over the first integument 300 as illustrated in FIG. 10 is more loosely draped. This dual integument system provides a natural feel to the animal doll 10, as the second integument 310 can be moved over the first, firmer integument 300 similar to the manner in which the skin and hide of a living animal can be moved over the underlying fascia and muscles.

In dolls 10 that do not contain a support system 200, the flexible integument 300 can be used to provide natural motion to the doll 10 in the following manner. It is contemplated by the present invention that fabrics having different elasticities and resiliencies could be combined in one doll 10 so that, for example, the front portion of an elbow joint would be covered with a portion of flexible integument 300 with very low elasticity, while the back portion of the elbow joint would be covered with a portion of flexible integument 300 with greater elasticity. Thus, it would be easier for such an elbow joint to flex in the direction away from the more elastic integument 300 than to flex in the opposite direction.

Combination of Support System 200 and Flexible Integument 300

Although dolls can be manufactured with a flexible integument 300 that provides a wide range of motion and a realistic feel as described above, the limbs of such dolls may still be able to be moved into positions that are not usually found in living beings. The present invention therefore contemplates a highly preferred embodiment in which dolls are constructed that have both a support system 200 and a flexible integument 300. Such dolls 10 are illustrated in FIGS. 1–3, 5–6, and 14–15.

In this highly preferred embodiment of the dolls 10 of the present invention, the flexible integument 300 is drawn over the support system 200. If, as in the dog doll 10 shown in FIGS. 2 and 3, the flexible integument 300 extends from neck to toe, the flexible integument 300 is first drawn over the support system 200, and then stuffing material 380 (as shown in FIG. 7) is stuffed into the flexible integument 300 and around the support system 200 to fill out the shape of the body. In an alternative preferred embodiment, the support system 200 can be first cushioned by wrapping it with foam (not shown) and/or disposing the stuffing material 380 around the support system 200 before the flexible integument 300 is drawn on.

If, as in the human doll 10 shown in FIG. 1, the flexible integument 300 extends only part way along the length of the limbs 20, 30 to the elbows and knee joints, one method of manufacturing a doll 10 having both the support system 200 and the flexible integument 300 is performed as follows. The rearward limbs 30 are first attached to the support system 200 using the modular interlocking system described hereinabove, or by conventional methods that will be known to those skilled in the art. Once the rearward limbs 30 and the support system 200 are connected, the flexible integument 300 can be drawn over this "skeleton" and attached to the proximal ends of the vinyl lower limbs 50 by such methods as gluing or stapling or other conventional methods to form a firm connection. The flexible integument 300 is then stuffed with stuffing material 380. As with the dog doll 10 discussed above, the support system 200 of the human doll 10 can be wrapped with foam or stuffing material 380 can be disposed around the support system 200 if desired before the flexible integument 300 is placed over it.

Once the bodies of the dolls 10 are prepared, the heads 12 are attached to the support system 200, for example, by connectors 700 as discussed above. The heads 12 can be manufactured of, for example, vinyl, or of any other conventional material that can be molded, as will be known by those skilled in the art. For the human dolls 10, this completes the basic manufacturing process. However, for the animal dolls 10, a second flexible integument 310 having a furry or hairy exterior may be drawn over the first flexible integument 300 as described above before the head 12 is attached.

Figure 12:
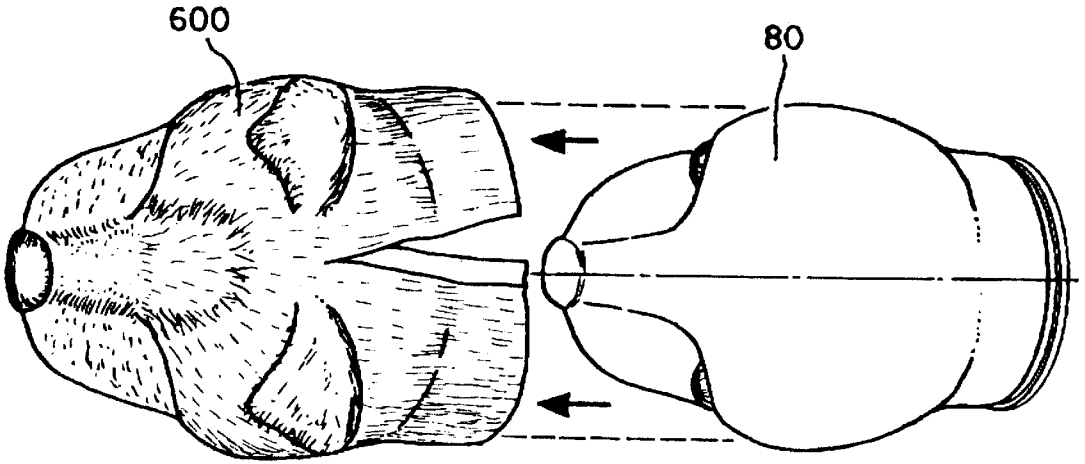
FIG. 12 is a top view of the head of a doll illustrating how the flexible integument is drawn over the molded head.
Figure 13:
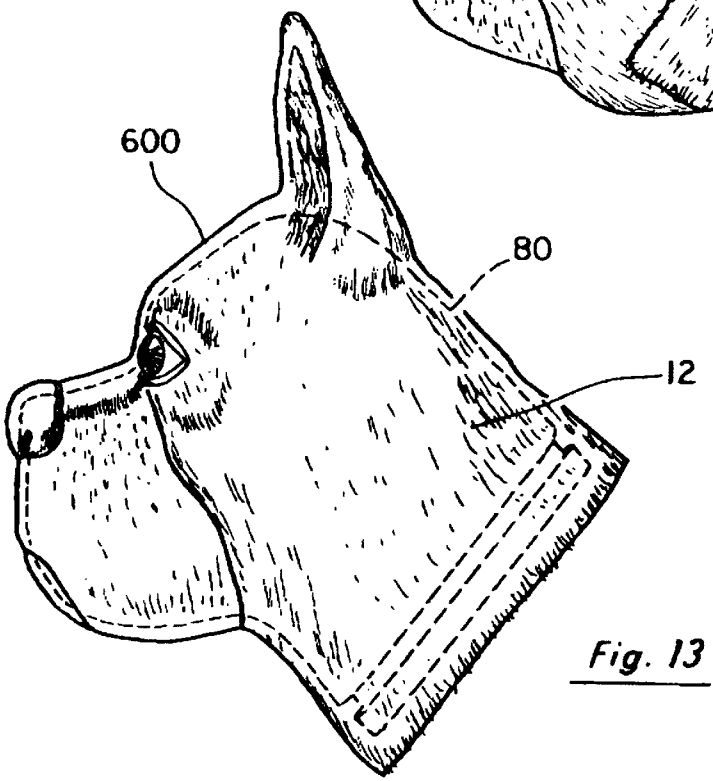
FIG. 13 is a side view of the head of the doll of FIG. 10 after the flexible integument is drawn over the molded head.

The heads 12 of the animal dolls 10 usually do not have two layers of flexible integument 300, 310. In animal dolls 10, the heads 12 are generally sculpted or molded of vinyl or another conventional substance to substantially model the actual shape of the head and face of the particular type of animal represented, such as the boxer dog shown in FIGS. 5, 12, and 13. For these heads 12 formed of molds 80, a separate portion 600 of the flexible integument 300 is drawn over the formed mold 80 like a glove is drawn onto a hand, to provide a textured exterior before the head 12 is attached to the body of the doll 10, as illustrated in FIGS. 12 and 13. This separate portion 600 of the flexible integument 300 often will have different stretch characteristics than those described above. That is, it is sometimes preferable for the separate portion 600 to be less elastic and more resilient than the flexible integument 300, 310 used on the body portion of such dolls 10. This would mean that the separate portion 600 would not be able to stretch as much and the flexible integument 300, 310 used on the body portion. It is contemplated under the teachings of the present invention that the separate portion 600 of the flexible integument 300 would have a potential stretch of about 0% to about 100%.

Figure 14:
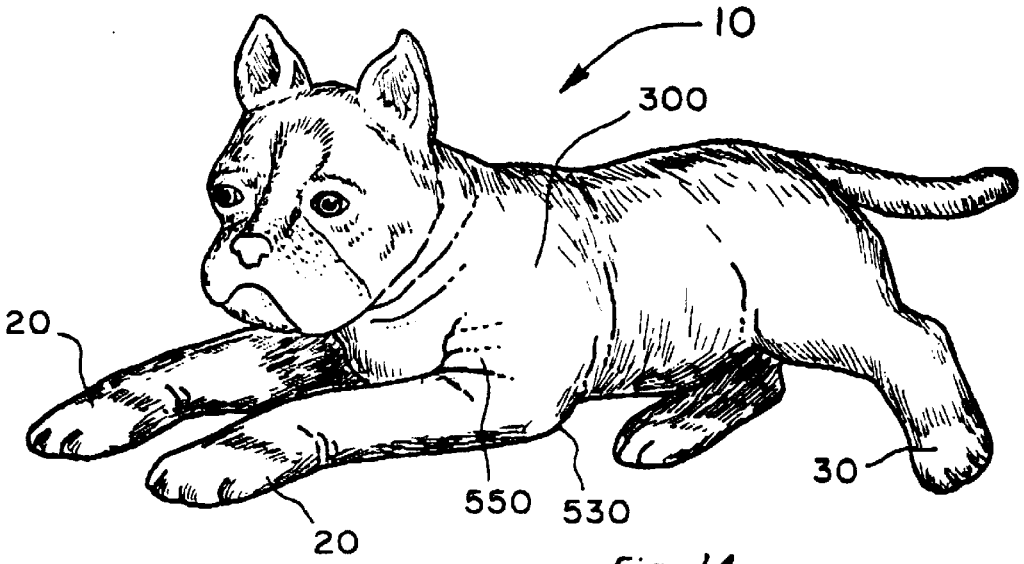
FIGS. 14 and 15 are perspective views of a doll posed in various natural positions according to the present invention.
Figure 15:
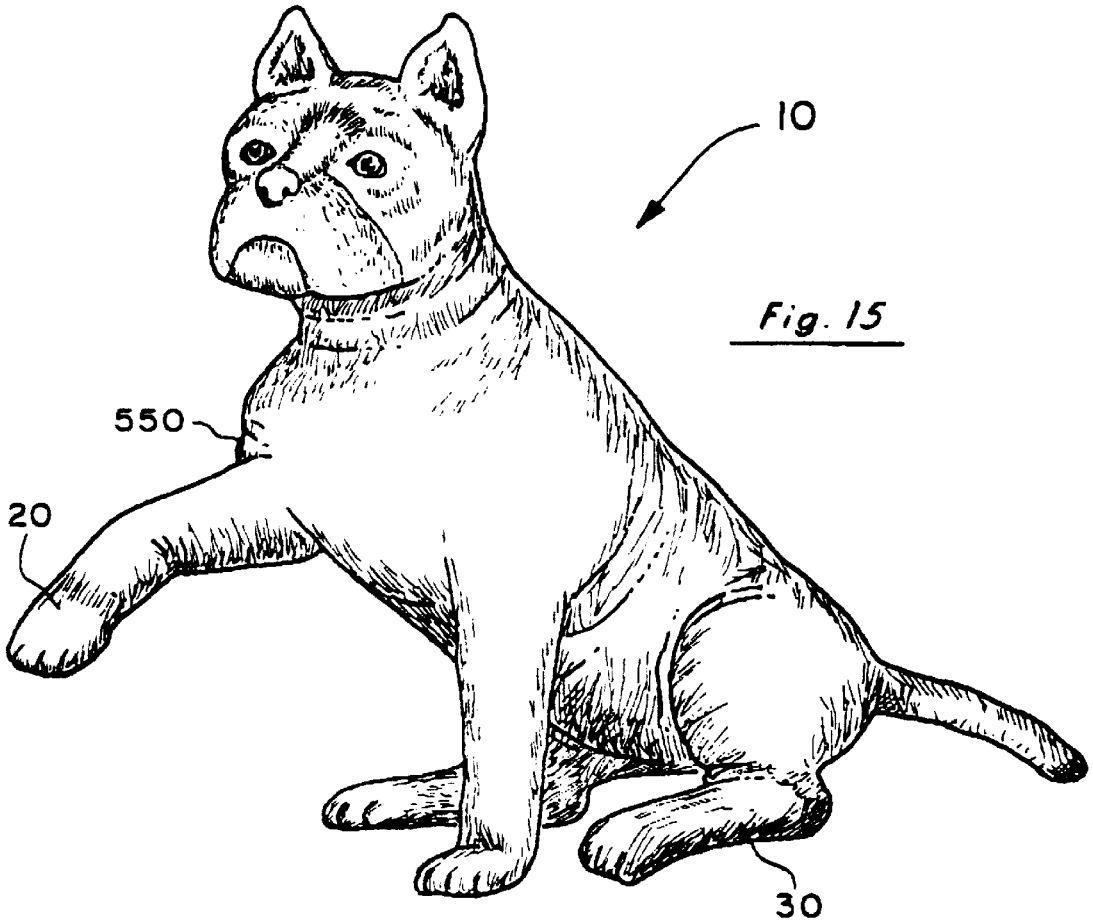

The dolls 10 of the highly preferred embodiment described above that have both a support system 200 and a flexible integument 300 can be moved in a natural predetermined range of motion throughout the entire range of motion that is found in the living beings that they represent, and without the use of unattractive excess fabric bunching at the joints when they are moved. Equally important, the limbs 20, 30 of dolls 10 that have both the support system 200 and the flexible integument 300 cannot be placed in positions that living creatures are unable to obtain. Thus, dolls 10 manufactured according to the present invention have a desirable natural and realistic appearance and feel and their limbs can be placed in a plurality of chosen true-to-life positions, as illustrated by the dog doll 10 in FIGS. 14 and 15. Furthermore, once the dolls 10 are put into a chosen position, the support system 200 will maintain that pose. This is illustrated by the dolls 10 in FIGS. 14 and 15. In FIG. 14, the doll 10 is placed in a recumbent position with the forward limbs 20 bent at the elbow joint and one of the rearward limbs 30 extended. The flexible integument 300 is slightly wrinkled 550 at the top of the elbow joint and is stretched 560 over the bottom of the elbow joint, and these reactions of the flexible integument 300 to the position of the forward limb 20 are no more than might be seen in a living dog. In FIG. 15, in contrast, the doll 10 has been posed in a sitting position with a forward limb 20 extended outward and the formerly extended rearward limb 30 flexed tightly. This pose can be maintained indefinitely by the support system 200 (not shown in FIG. 15) against the weight of the forward limb 20.

The above discussion represents an important feature of the present invention in that the design of a jointed limb constructed with the support system, stuffing, and flexible integument of the present invention can be utilized in and of itself to create a lifelike, poseable limb whether or not used with other doll elements.

The above disclosure sets forth a number of embodiments of the present invention. Other arrangements or embodiments, not precisely set forth, could be practiced under the teachings of the present invention and as set forth in the following claims.

We claim:

1. A doll comprising:

a body;

a flexible connector;

a head connected to said body by said flexible connector;

a support system hidden within said body, said support system at least including:

a forward section proximal to said head, said forward section having said flexible connector;

at least one forward limb connected to said forward section;

a flexible first component, said flexible first component having a plurality of self-attaching modules;

a rearward section distal to said head, said rearward section connected to said forward section by said flexible first component; and at least one rearward limb connected to said rearward section;

stuffing material disposed around said support system; and a flexible integument covering said stuffing material and said support system.

2. The doll of claim 1 wherein said forward section and said rearward section are rigid.

3. The doll of claim 2 wherein said at least one forward limb and said at least one rearward limb each comprise an upper portion, a lower portion, and a hinge component between said upper portion and said lower portion.

4. The doll of claim 3 wherein said support system further comprises a straight component within said upper portion and within said lower portion of said at least one forward limb and within said upper portion and within said lower portion of said at least one rearward limb.

5. The doll of claim 4 wherein said support system further comprises a ball-and-socket component between said forward section and said at least one forward limb and between said rearward section and said at least one rearward limb.

6. The doll of claim 1 further comprising a tail connected to said rearward section of said support system.

7. The doll of claim 1 wherein said flexible integument has both elasticity and resiliency.

8. The doll of claim 1 wherein said flexible integument has a potential stretch length between about 0% and about 100%.

9. A doll comprising:

a body;

a flexible connector;

a head connected to said body by said flexible connector;

a support system hidden within said body, said support system at least including:

a forward section;

at least one forward limb connected to said forward section, said at least one forward limb having an upper portion and a lower portion;

a flexible first component, said flexible first component having a plurality of self-attaching modules;

a rearward section connected to said forward section by said flexible first component;

at least one rearward limb connected to said rearward section, said at least one rearward limb having an upper portion and a lower portion;

a straight component contained within said upper portion and within said lower portion of said at least one forward limb and said at least one rearward limb;

a hinge component between said straight component in said upper portion and said straight component in said lower portion; and a ball-and-socket component between said forward section and said at least one forward limb and between said rearward section and said at least one rearward limb;

stuffing material disposed around said support system; and a flexible integument covering said stuffing material and said support system.

10. The doll of claim 9 wherein said forward section and said rearward section are rigid.

11. The doll of claim 9 further comprising a tail connected to said rearward section of said support system.

12. The doll of claim 9 wherein said flexible integument has both elasticity and resiliency.

13. The doll of claim 12 wherein said flexible integument has a potential stretch length between about 0% and about 100%.

14. A doll comprising:

a body;

a flexible connector;

a head connected to said body by said flexible connector, said flexible connector causing said head to maintain position when said head moves in relation to said body in a predetermined natural range;

a support system hidden within said body, said support system at least including:

a forward section proximal to said head, said forward section having said flexible connector;

two forward limbs pivotally connected to opposite sides of said forward section;

each of said two forward limbs at least having an upper portion and a lower portion;

a flexible first component, said flexible first component having a plurality of self-attaching modules, said self-attaching modules causing said flexible first component to maintain position when said flexible first component is moved in a first predetermined, natural range, said self-attaching modules causing said flexible first component to have an unlimited range of flexion;

a rearward section distal to said head, said rearward section connected to said forward section by said flexible first component;

two rearward limbs pivotally connected to opposite sides of said rearward section;

each of said two rearward limbs at least having an upper portion and a lower portion;

stuffing material disposed around said support system; and a flexible integument covering said stuffing material and said support system, said flexible integument having elasticity and resiliency, said flexible integument having a potential stretch in a range of about 0% to about 100%, said elasticity enabling said flexible integument to stretch and said resiliency enabling said flexible integument to recover when said limbs are moved.

15. The doll of claim 14 wherein said forward section and said rearward section are rigid.

16. The doll of claim 14 further comprising a tail connected to said rearward section of said support system.

17. The doll of claim 14 further comprising a ball-and-socket component between said two forward limbs and said forward section and between said two rearward limbs and said rearward section, said ball-and-socket component causing said two forward limbs and said two rearward limbs to maintain position when said limbs are moved in a second predetermined range.

18. The doll of claim 14 further comprising a hinge component between said upper portion and said lower portion of said forward limb, said hinge component causing said lower portion to maintain position when said lower portion is moved in a first predetermined direction a first predetermined number of degrees.

19. The doll of claim 14 further comprising a hinge component between said upper portion and said lower portion of said rearward limb, said hinge component causing said lower portion to maintain position when said lower portion is moved in a second predetermined direction a second predetermined number of degrees.

* * * * *